US007545247B2

(12) United States Patent
Zindler

(10) Patent No.: US 7,545,247 B2
(45) Date of Patent: Jun. 9, 2009

(54) ELECTRICAL SWITCHING APPARATUS, AND CASE AND TERMINAL SHIELD THEREFOR

(75) Inventor: Mark O. Zindler, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 105 days.

(21) Appl. No.: 11/560,423

(22) Filed: Nov. 16, 2006

(65) Prior Publication Data

US 2008/0116046 A1 May 22, 2008

(51) Int. Cl.
*H01H 9/06* (2006.01)
*H01H 75/00* (2006.01)
*H01H 13/04* (2006.01)

(52) U.S. Cl. ..... 335/202; 335/6; 200/293; 200/304; 200/306

(58) Field of Classification Search ..... 335/6, 335/8–11, 202; 200/293, 296, 303–307
See application file for complete search history.

(56) References Cited

U.S. PATENT DOCUMENTS 2,690,486 A * 9/1954 Wilckens ..... 335/161
3,290,627 A * 12/1966 Davis et al. ..... 335/9
3,354,277 A * 11/1967 Stanback et al. ..... 337/8
3,842,376 A * 10/1974 Mune ..... 335/202
4,077,024 A * 2/1978 Lisnay ..... 335/8
4,595,896 A * 6/1986 DiMarco et al. ..... 335/202
5,436,604 A * 7/1995 Mrenna et al. ..... 335/202
5,453,723 A * 9/1995 Fello et al. ..... 335/18
5,831,498 A * 11/1998 Maloney et al. ..... 335/8
6,307,456 B1 * 10/2001 Caggiano et al. ..... 335/202
6,541,722 B1 * 4/2003 Whipple et al. ..... 200/293
6,614,334 B1 * 9/2003 Gibson et al. ..... 335/202
7,041,921 B2 * 5/2006 Kadan et al. ..... 200/293

OTHER PUBLICATIONS

Airpax, "IELR Rail-Mount Magnetic Circuit Protectors", pp. 1-11, www.airpax.net, as printed Nov. 2006.
Carling Technologies, "D-Series", pp. 1-6, www.carlingtech.com, as printed Nov. 2006.
Cutler-Hammer, "Supplementary Protectors SPHM", pp. 1-2, www.eatonelectrical.com, as printed Nov. 2006.

* cited by examiner

*Primary Examiner*—Ramon M Barrera
(74) *Attorney, Agent, or Firm*—Martin J. Moran

(57) ABSTRACT

A terminal shield is provided for an electrical switching apparatus including a case having a first housing member, a second housing member coupled to and disposed opposite from the first housing member, a first end, a second end, a number of terminals, and a number of terminal openings. Each of the first and second housing members has a first side and a second side. The terminal shield includes at least one pair of protrusions extending outwardly from the case on opposing sides of a corresponding one of the terminal openings. Each protrusion has an interior surface facing a corresponding one of the terminals, and an exterior surface disposed opposite the interior surface. The exterior surface of each protrusion aligns with the first side of a corresponding one of the first and second housing members.

2 Claims, 5 Drawing Sheets

ELECTRICAL SWITCHING APPARATUS, AND CASE AND TERMINAL SHIELD THEREFOR

CROSS-REFERENCE TO RELATED APPLICATION

This application is related to commonly assigned, concurrently filed:

U.S. patent application Ser. No. 11/560,438, filed Nov. 16, 2006, entitled "ELECTRICAL SWITCHING APPARATUS AND VENTED CASE THEREFOR"

BACKGROUND OF THE INVENTION

1. Field of the Invention

The invention relates generally to electrical switching apparatus and, more particularly, to cases, such as molded cases, for electrical switching apparatus. The invention also relates to terminal shields for electrical switching apparatus.

2. Background Information

Electrical equipment such as, for example, relays, circuit breakers, electric meters and transformers, are typically housed within an electrical enclosure such as, for example, a housing such as a cabinet.

Panelboards or load centers, for example, are types of electrical enclosures which serve to distribute power for residential or commercial applications. Typically, the panelboard or load center includes a housing enclosing a plurality of electrical switching apparatus (e.g., without limitation, circuit breakers) for protecting branch circuits against electrical faults or overload conditions. It is desirable to maximize the efficiency with which the available space within the housing is used. Accordingly, the circuit breakers are often disposed, for example, adjacent one another in parallel rows with one or more bus bars extending between the rows. The circuit breakers may also be removably coupled to a DIN rail. DIN is short for Deutsches Insitut für Normung eV, which is a German standard-setting organization. Accordingly, a DIN rail is a connecting rail structure which is designed to satisfy DIN standards. Some manufacturers of circuit breakers provide the circuit breaker with a DIN rail mounting structure, such as an integrally molded recess sized to provide snap-on attachment to the DIN rail.

FIG. 1 shows an example of three such circuit breakers 2, which are ganged (e.g., coupled) together side-by-side. Each circuit breaker 2 is essentially identical, including a case 6 with a first half 8 and a second half 10. Handles 12 protrude from the top (from the perspective of FIG. 1) of the cases 6 and, in the example of FIG. 1, are ganged (e.g., coupled) together. The end 4 of each circuit breaker 2 includes a terminal 14, with protrusions 16,18 being disposed on opposite sides of the terminals 14. A single vent 20 provides the sole means for ventilating ionized gases from within each circuit breaker 2. The interior of the second half 10 of one of the circuit breakers 2, and the terminal 14, protrusion 18 and vent 20 thereof are shown in FIG. 2, which also shows the aforementioned molded DIN rail mounting structure 22.

Circuit breakers (e.g., circuit breaker 2) are subject to industry safety regulations. For example and without limitation, the Underwriter's Laboratory (UL) establishes minimum spacing requirements between the terminals of adjacent circuit breakers. Specifically, there is both a "through air" minimum spacing requirement, and an "over surface" minimum spacing requirement. "Through air" refers to the shortest direct path over which an arc could potentially jump, through the air, for example between respective terminals 14 of any two of the adjacent circuit breakers 2. "Over surface" refers to the shortest path between, for example, adjacent terminals 14 wherein such path is over the surface of a portion or portions (e.g., protrusions 16,18) of the respective circuit breaker casings 6 of the adjacent circuit breakers 2.

It will be appreciated that it is difficult to satisfy such regulations while simultaneously meeting the design goal of minimizing the space required for the circuit breakers, and thus the overall space required for the corresponding electrical enclosure. It is, therefore, desirable to space circuit breakers as closely together as possible while satisfying industry safety standards such as, for example, minimum terminal spacing requirements.

There is, therefore, room for improvement in electrical switching apparatus and in cases therefor.

SUMMARY OF THE INVENTION

These needs and others are met by embodiments of the invention, which are directed to terminal shields for the cases of electrical switching apparatus, such as circuit breakers.

As one aspect of the invention, a terminal shield is provided for an electrical switching apparatus. The electrical switching apparatus includes a case having a first housing member, a second housing member coupled to and disposed opposite from the first housing member, a first end, a second end, a number of terminals, and a number of terminal openings. Each of the first housing member and the second housing member has a first side and a second side. The terminal shield comprises: at least one pair of protrusions structured to extend outwardly from the case on opposing sides of a corresponding one of the terminal openings, wherein each protrusion of such pair of protrusions has an interior surface structured to face a corresponding one of the terminals, and an exterior surface disposed opposite the interior surface. The exterior surface of the protrusion is structured to align with the first side of a corresponding one of the first housing member and the second housing member.

The number of terminal openings may comprise a first terminal opening and a second terminal opening, wherein the interior surface of each protrusion is structured to be disposed proximate a corresponding one of the first terminal opening and the second terminal opening. The interior surface of each protrusion may be structured to abut the corresponding one of the first and second terminal openings, and each protrusion may be structured to extend between the corresponding one of the first and second terminal openings and the first side of the corresponding one of the first and second housing members. The interior surface of each protrusion and the exterior surface of each protrusion may be substantially parallel with respect to one another, and each protrusion may extend substantially perpendicularly outwardly from a corresponding one of the first end of the case and the second end of the case.

Each protrusion may comprise a first end, a second end, a first side and a second side. The first end of each protrusion may be structured to be coupled to a corresponding one of the first end of the case and the second end of the case, and the second end of each protrusion may be disposed opposite and distal from the first end of the each protrusion. The first side of each protrusion may be structured to extend beyond a corresponding one of the terminal openings on one side thereof, and the second side of each protrusion may be structured to extend beyond the corresponding one of the terminal openings on the other side thereof. Each protrusion may be generally rectangular in shape.

The first housing member and the second housing member may comprise a first single piece molded member and a second single piece molded member, and the at least one pair of protrusions may comprise a pair of first protrusions and a pair of second protrusions. The pair of first protrusions may comprise a first integral extension structured to extend outwardly from one end of the first single piece molded member and a corresponding first integral extension structured to extend outwardly from one end of the second single piece molded member, which is adjacent such end of the first single piece molded member. The pair of second protrusions may comprise a second integral extension structured to extend outwardly from the other end of the first single piece molded member and a corresponding second integral extension structured to extend outwardly from the other end of the second single piece molded member, which is adjacent such other end of the first single piece molded member.

As another aspect of the invention, a case is provided for an electrical switching apparatus. The case comprises: a first end including a first terminal and a first terminal opening; a second end including a second terminal and a second terminal opening; a first housing member including a first side and a second side; a second housing member coupled to and disposed opposite from the first housing member, the second housing member including a first side and a second side; and a pair of terminal shields comprising: a pair of first protrusions extending outwardly from the first end of the case on opposing sides of the first terminal opening, and a pair of second protrusions extending outwardly from the second end of the case on opposing sides of the second terminal opening. Each protrusion of the pair of first protrusions of such terminal shield and the pair of second protrusions of the pair of terminal shields has an interior surface facing a corresponding one of the first terminal and the second terminal, and an exterior surface disposed opposite the interior surface. The exterior surface of each protrusion aligns with the first side of a corresponding one of the first housing member and the second housing member of the case.

The case may have a first width, and each protrusion of the pair of first protrusions of the pair of terminal shields and the pair of second protrusions of the pair of terminal shields may have a second width. A corresponding one of the pair of first protrusions and the pair of second protrusions may have a combined second width of at least about 40 percent of the first width of the case of the electrical switching apparatus.

As another aspect of the invention, an electrical switching apparatus comprises: a case including a first end having a first terminal and a first terminal opening and a second end having a second terminal and a second terminal opening; a first housing member including a first side and a second side; a second housing member coupled to and disposed opposite from the first housing member, the second housing member including a first side and a second side; and a pair of terminal shields comprising: a pair of first protrusions extending outwardly from the first end of the case on opposing sides of the first terminal opening, and a pair of second protrusions extending outwardly from the second end of the case on opposing sides of the second terminal opening. Each protrusion of the pair of first protrusions of the pair of terminal shields and the pair of second protrusions of the pair of terminal shields has an interior surface facing a corresponding one of the first terminal and the second terminal, and an exterior surface disposed opposite the interior surface. The exterior surface of each protrusion aligns with the first side of a corresponding one of the first housing member and the second housing member.

The terminal shields may be structured to provide both over surface spacing and through air terminal spacing in accordance with Underwriter's Laboratory (UL) 489.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
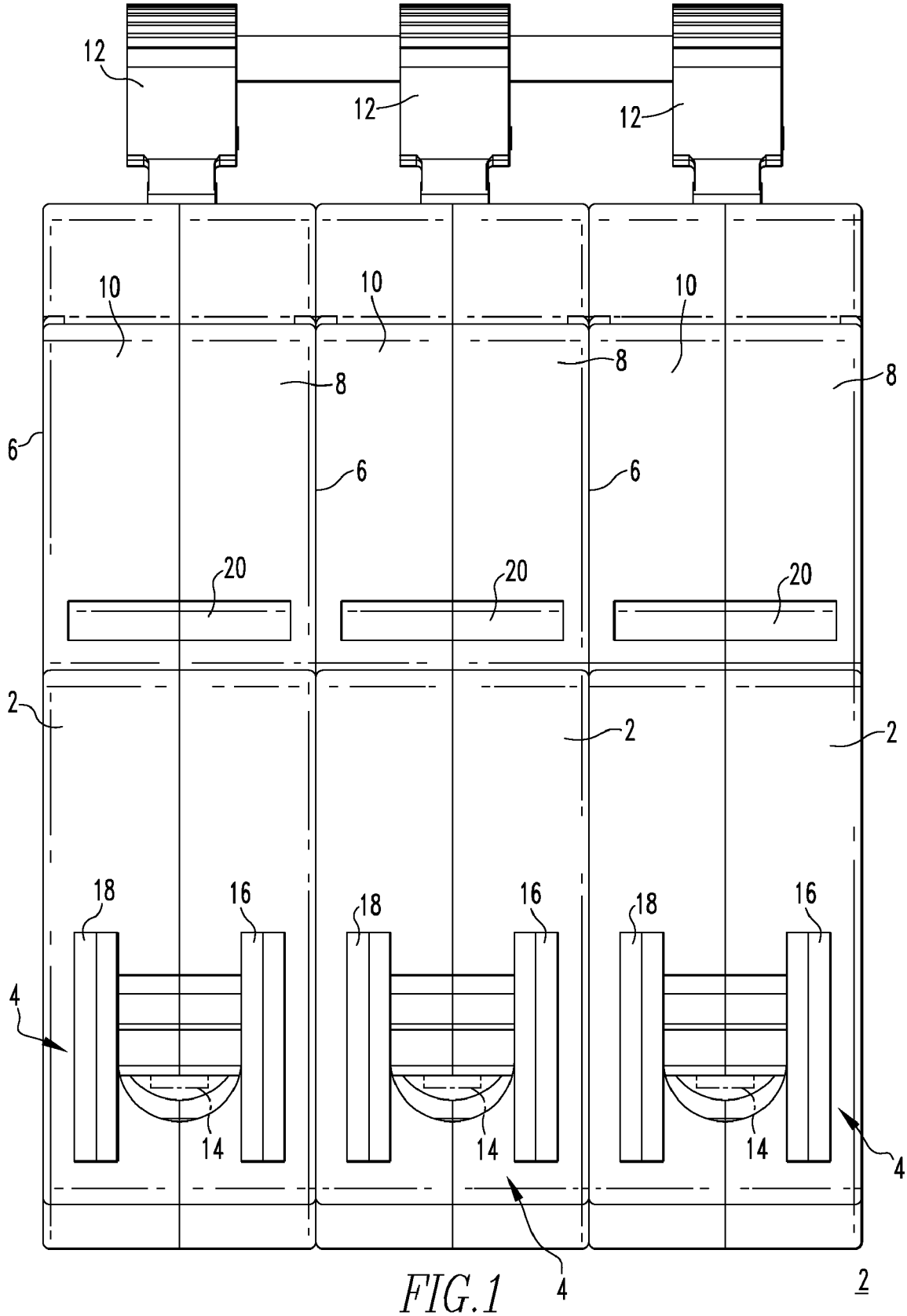
FIG.1 PRIOR ART
FIG. 1 is an end elevation view of three circuit breakers which are ganged together side-by-side.

For purposes of illustration, embodiments of the invention will be described as applied to three molded case circuit breakers which are ganged together side-by-side, although it will become apparent that they could also be applied to a wide variety of electrical switching apparatus (e.g., without limitation, circuit switching devices and other circuit interrupters, such as contactors, motor starters, motor controllers and other load controllers) having an arc chute, which are arranged in any suitable number and/or configuration.

Directional phrases used herein, such as, for example, left, right, top, bottom, upper, lower, front, back and derivatives thereof, relate to the orientation of the elements shown in the drawings and are not limiting upon the claims unless expressly recited therein.

As employed herein, the term "ionized" means completely or partially converted into ions, or ions and electrons, and being at least somewhat electrically conductive such as, for example, ionized gases generated by arcing between separable electrical contacts of a circuit breaker when opened.

As employed herein, the terms "case" or "casing" and derivatives thereof refer to any known or suitable enclosure or housing structured to contain the internal components (e.g., without limitation, operating mechanism; separable contacts; arc chute) of an electrical switching apparatus such as, for example and without limitation, a circuit breaker.

As employed herein, the term "vented" refers to the nature of the disclosed case for electrical switching apparatus, wherein the case has a number of vents or other known or suitable structures which enable the electrical switching apparatus to expel or otherwise suitably release or discharge undesirable gas (e.g., ionized gas) and/or matter from within the case to the exterior thereof.

As employed herein, the term "vent" refers to any known or suitable mechanism, opening and/or passage which functions, for example, to expel or otherwise suitably release or discharge undesirable gas (e.g., ionized gas) and/or matter from within the case of an electrical switching apparatus to the exterior thereof.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
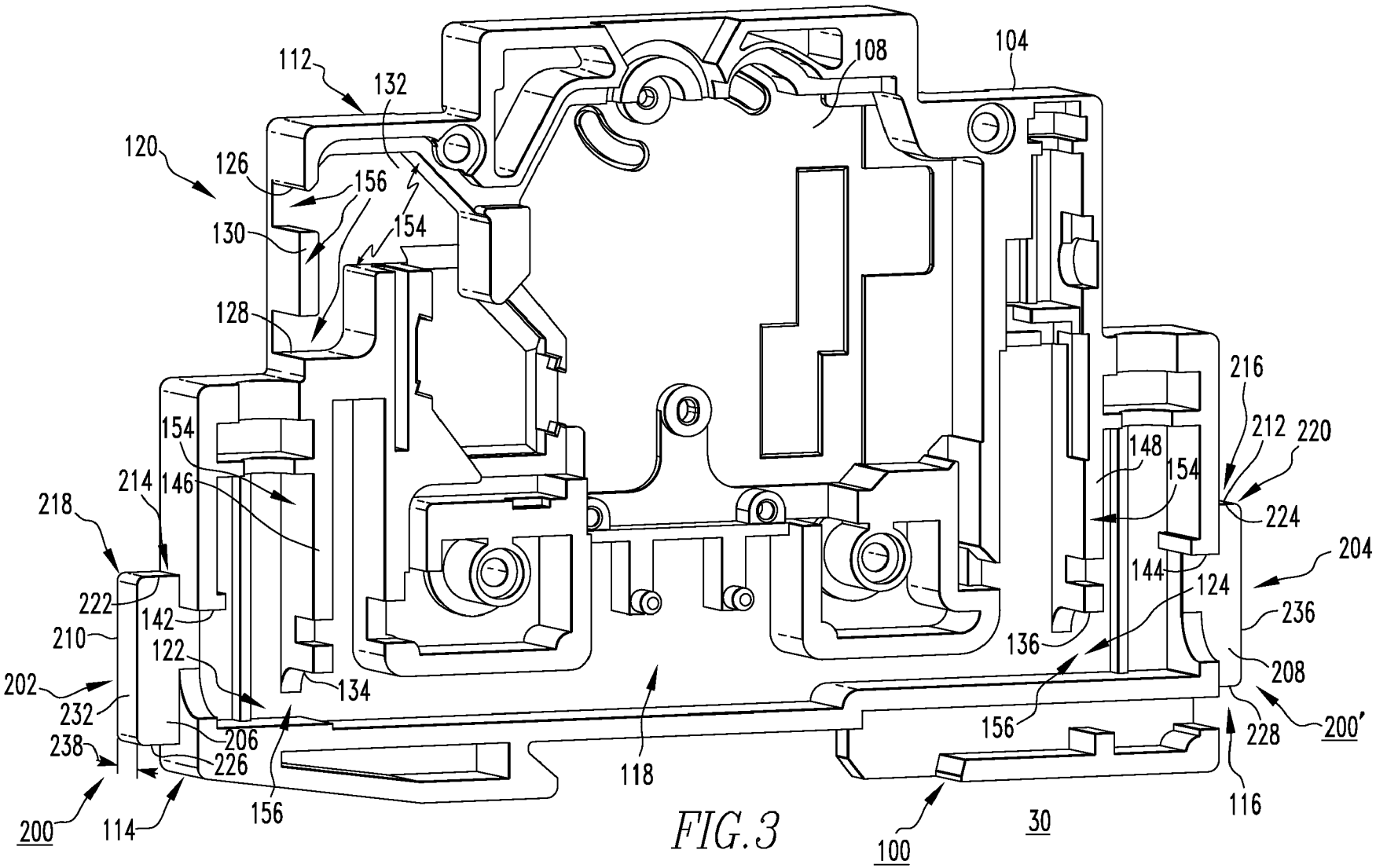
FIG. 3 is an isometric view of the interior of one half of a vented case for a circuit breaker, in accordance with an embodiment of the invention.
Figure 4:
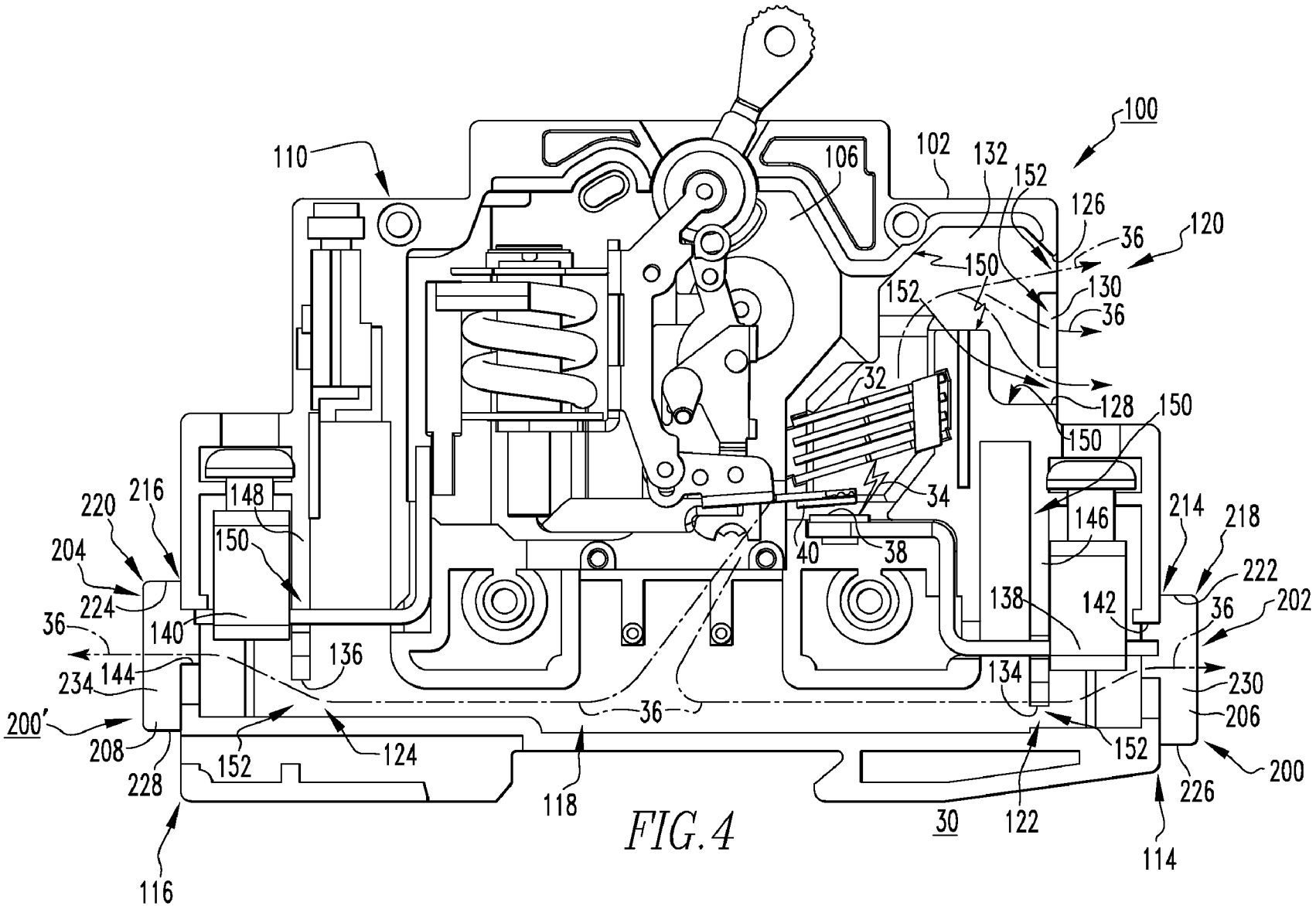
FIG. 4 is a side elevation view of the other half of a vented case for a circuit breaker in accordance with an embodiment of the invention, also showing internal structures of the circuit breaker.

FIGS. 3 and 4 show portions of a case 100 for an electrical switching apparatus, such as a circuit breaker 30. The case 100 is vented in accordance with an embodiment of the invention. The circuit breaker 30 generally includes an arc chute 32 and separable contacts, such as the stationary contact 38 and movable contact 40, shown in FIG. 4. The arc chute 32 is housed by the vented case 100, and is disposed proximate the separable contacts 38,40 therein. The arc chute 32 is, therefore, structured to attract and dissipate an arc 34 (shown in simplified form in FIG. 4) from the separable contacts 38,40. The arc 34 is generated when the separable contacts 38,40 separate, for example, after the circuit breaker 30 trips. Ionized gas, which is indicated generally by arrows 36 in FIG. 4, is produced as a by-product of the arc 34. Such ionized gas 36 can be damaging to the internal components (e.g., without limitation, arc chute 32; separable contacts 38,40) of the circuit breaker 30. For example, ionized gas 36 can facilitate additional, undesired arcs (not shown). Accordingly, it is strongly desirable to rapidly vent such ionized gas 36 from the circuit breaker 30. Additionally, circuit breakers (e.g., 30) which are employed, for example and without limitation, to provide branch circuit protection, are subject to stringent industry regulations. One such regulation, which is generally well known, is Underwriter's Laboratory (UL) 489 which governs certain standards for branch circuit breakers. Among other benefits, the disclosed circuit breaker 30 and structures thereof, including the vented case 100 and the terminal shields 200,200' which will be discussed hereinbelow, meet or exceed the requirements of UL 489.

The vented case 100 in the example shown and described herein, includes at least one housing member 102 (FIGS. 4 and 5), 104 (FIGS. 3 and 5) having an interior 106 (FIGS. 4 and 5) and 108 (FIGS. 3 and 5), an exterior 110 (FIGS. 4 and 5) and 112 (FIGS. 3 and 5), a first end 114, a second end 116 (FIGS. 3 and 4) disposed generally opposite and distal from the first end 114, and an intermediate portion 118 (FIGS. 3 and 4) between the first and second ends 114,116. The example vented case 100 comprises a first housing member 102, shown in FIGS. 4 and 5, and a second housing member 104, shown in FIGS. 3 and 5, which is coupled to and disposed opposite from the first housing member 102, as shown in FIG. 5 (FIG. 5 shows three such vented cases 100, one for each of three adjacent circuit breakers 30 which are ganged together, side-by-side, and which are all substantially identical).

Figure 5:
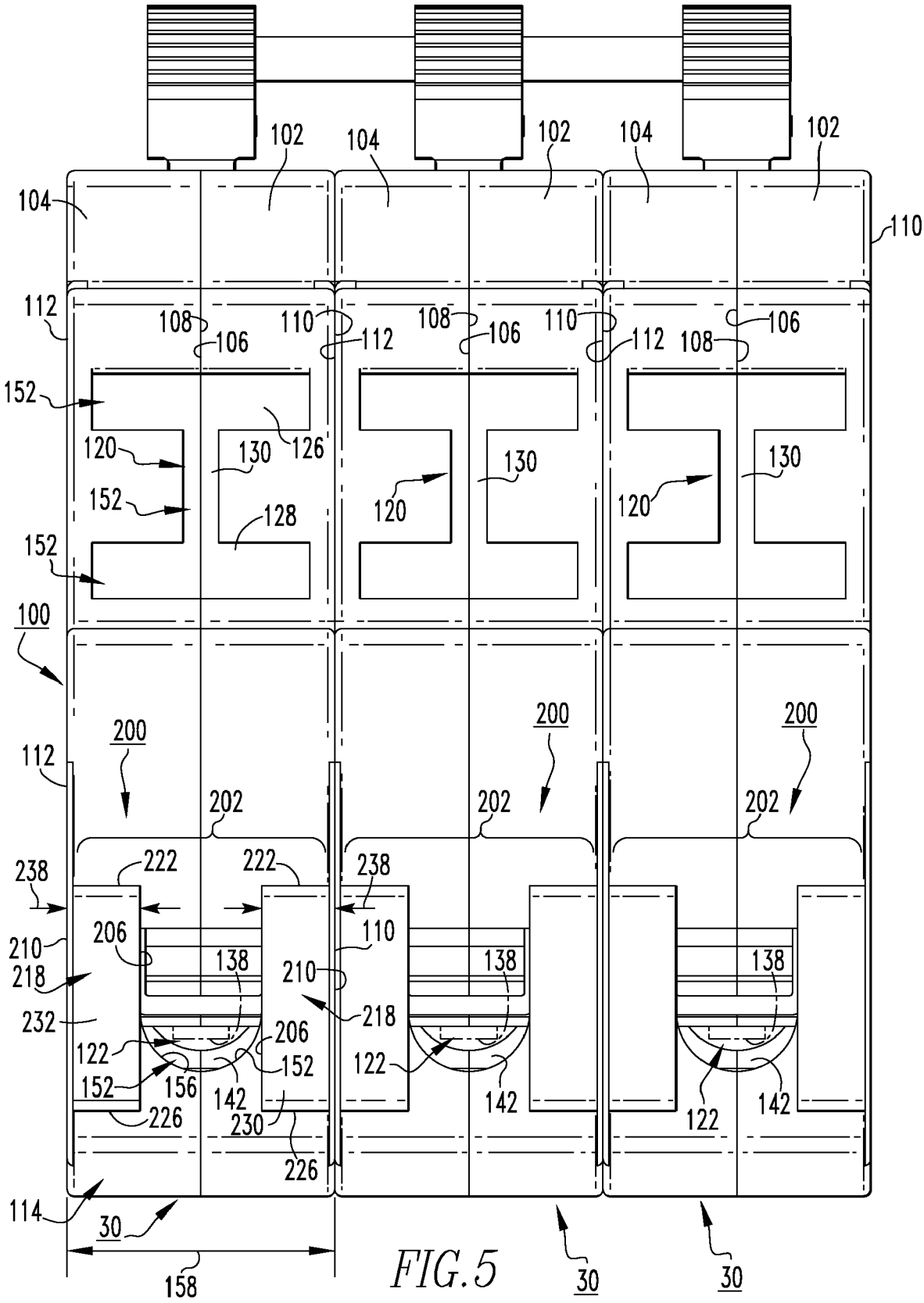
FIG. 5 is an end elevation view of three circuit breakers which are ganged together side-by-side, with each circuit breaker employing a vented case in accordance with an embodiment of the invention.

The vented case 100 further includes at least one vent 120,122,124 structured to discharge the ionized gas 36 (FIG. 4) from the interior 106 (FIGS. 4 and 5) and 108 (FIGS. 3 and 5) of the housing members 102 (FIGS. 4 and 5) and 104 (FIGS. 3 and 5) to the exterior 110 (FIGS. 4 and 5) and 112 (FIGS. 3 and 5). As will be discussed, each vent 120,122,124 includes a plurality of venting passages 126,128,130 (best shown in FIG. 5), 132,134,136 structured to extend from proximate the arc chute 32 (FIG. 4) within the case 100, to the exterior of the circuit breaker 30 (FIGS. 4 and 5). The example vented case 100 includes a primary vent 120, which is disposed at or about the first end 114 of the vented case 100. For simplicity of disclosure and ease of illustration, only one of the vented cases 100 (the left most case 100 from the perspective of FIG. 5) will be described in detail. It will however, be appreciated that the other two circuit breakers 30 and vented cases 100 therefor, are substantially identical.

Figure 2:
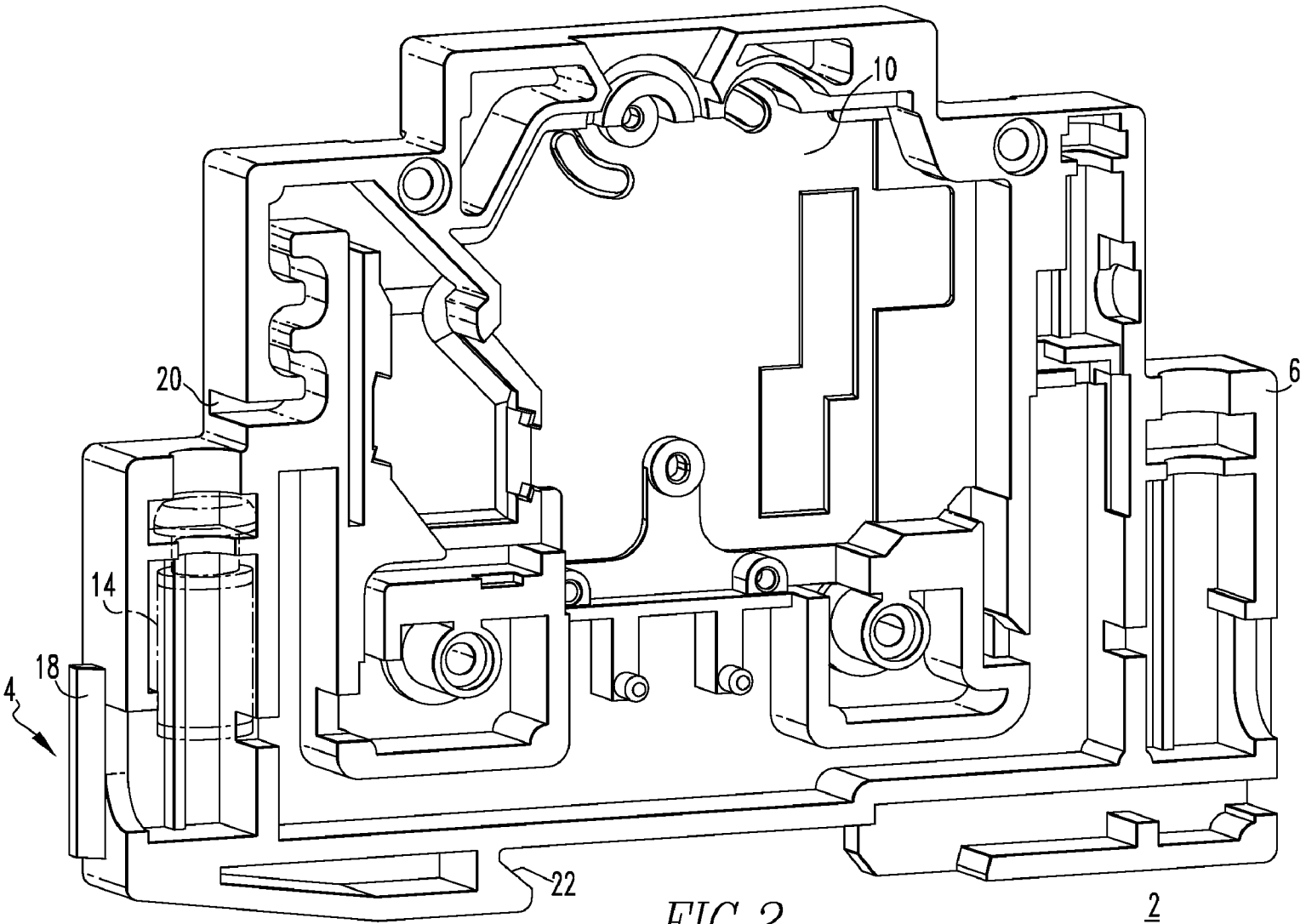
FIG. 2 PRIOR ART
FIG. 2 is an isometric view of the interior of one half of the case of one of the circuit breakers of FIG. 1.

Specifically, the primary vent 120 includes at least a first venting passage 126, and a second venting passage 128 which is spaced from but proximate to the first venting passage 126. The first venting passage 126 of the example primary vent 120 combines with a portion of the second venting passage 128 to form a common venting passage 132, as shown in FIGS. 3 and 4. The common venting passage 132 is disposed proximate the arc chute 32 of the circuit breaker 30, as shown in FIG. 4. In this manner, the cross-sectional area and overall volume available for discharging the ionized gas 36 (FIG. 4) from the arc chute 32 (FIG. 4) out of the primary vent 120, is greatly increased in comparison with known circuit breaker vents such as, for example, vent 20 and the relatively narrow serpentine single venting passage thereof of FIG. 2, previously discussed. Accordingly, the primary vent 120 of the disclosed vented case 100 greatly improves the venting efficiency of the circuit breaker 30.

The venting efficiency of the disclosed circuit breaker 30 is still further improved through the inclusion of several other additional unique features. Among them is a third venting passage 130 (best shown in FIG. 5) of the vented case 100 which interconnects the first and second venting passages 126,128 of the primary vent 120 and, in the example shown and described herein, is also substantially perpendicular with respect to such passages 126,128. Accordingly, it will be appreciated that the exemplary primary vent 120 is generally shaped like a capital letter "I", when the vented case 100 is viewed from the end elevation perspective of FIG. 5. It will also be appreciated that the three venting passages 126,128,130 of the I-shaped primary vent 120 provide a substantially increased cross-sectional venting area as compared, for example, to the single relatively narrow, rectangular-shaped vent 20 of FIG. 1, previously discussed. It will, however, be appreciated that the primary vent 120 could have any known or suitable alternative shape (not shown) and/or count of venting passages (not shown) other than the example "I" shape and/or three venting passages 126,128,130, which are shown, without departing from the scope of the invention.

In addition to the aforementioned primary vent 120, the example vented case 100 further includes at least one secondary vent 122,124 (only one secondary vent 122 is shown in FIG. 5). Specifically, the first end 114 of the vented case 100, includes a first terminal 138 and a first terminal opening 142 therefor, and the second end 116 (FIGS. 3 and 4) of the vented case 100 includes a second terminal 140 (FIG. 4) and a second terminal opening 144 (FIGS. 3 and 4) therefor. The example vented case 100 includes a first secondary vent 122 in the form of a first vent aperture disposed at or about the first terminal 138, and a second secondary vent 124 (FIGS. 3 and 4) in the form of a second vent aperture disposed at or about the second terminal 140 (FIG. 4). It will be appreciated with reference to the dashed lines of FIG. 4, which represent the aforementioned ionized gas 36, that a first secondary venting passage 134 extends from the intermediate portion 118 of the housing member 102 to the first secondary vent 122, and a secondary venting passage 136 extends from the intermediate portion 118 to the second secondary vent 124.

In other words, the aforementioned venting passages (e.g., 126,128,130,132,134,136) of the vents (e.g., 120,122,124), are formed by the alignment of a plurality of first protrusions 150 which extend outwardly from the interior 106 of the first housing member 102, as shown in FIG. 4, and align with a corresponding plurality of second protrusions 154 which extend outwardly from the interior 108 of the second housing member 104, as shown in FIG. 3. Specifically, the venting passages (e.g., 126,128,130,132,134,136) are formed by the passages extending between the aligned first and second protrusions 150,154. Similarly, the vents (e.g., 120,122,124) are formed by the apertures or thru holes created by the alignment of corresponding first and second recesses 152,156 of the first and second housing members 102,104 (see, for example, vent 122 in FIG. 5). Accordingly, it will be appreciated that the exemplary first and second housing members 102,104 are contemplated as comprising molded housing members, wherein the aforementioned protrusions 150,154 and recesses 152,156 are molded portions of the interiors 106,108 of the molded housing members 102,104. It will also be appreciated that the molded housing members 102,104 may be made from any known or suitable electrically insulative material such as, for example and without limitation, plastic, and that they preferably each comprise one single piece of material.

As shown in FIGS. 3 and 4, the example protrusions 150 (FIG. 4), 154 (FIG. 3) form a number of substantially vertical walls, such as the first and second substantially vertical walls 146,148, shown, which are disposed proximate the first terminal 138 of the first end 114 of vented case 100 and the second terminal 140 of the second end 116 of vented case 100, respectively. The example first and second secondary vents 122,124 comprise respective apertures through the first and second substantially vertical walls 146,148, as shown.

The disclosed circuit breaker 30 also includes at least one terminal shield 200,200' (terminal shield 200' is partially shown, only in FIGS. 3 and 4) which, among other benefits, provides improved through air and over surface spacing between the terminals (e.g., first and second terminals 138 (FIGS. 4 and 5), 140 (FIG. 4)) of the circuit breaker 30. Thus, the disclosed circuit breaker 30 provides improved resistance, for example, to undesired arcing between adjacent circuit breaker terminals (e.g., without limitation, adjacent terminals 138 of adjacent circuit breakers 30 of FIG. 5), in comparison with known prior art circuit breaker terminal designs (see, for example, relatively narrow and tapered protrusions 16,18 of terminals 14 of circuit breaker 2 of FIG. 1). Like the aforementioned vented case 100, such terminal shields 200,200' also meet or exceed well established industry safety regulations such as, for example and without limitation, Underwriter's Laboratory (UL) 489.

For simplicity of disclosure only one of the terminal shields 200 for one of the circuit breakers 30 of FIG. 5 will be described in detail. It will, however, be appreciated that the other breakers 30 and terminal shields 200' therefor, are substantially identical. As shown in FIG. 5, each terminal shield 200 includes at least one pair of protrusions 202 structured to extend outwardly (best shown in FIGS. 3 and 4) from the circuit breaker case 100 on opposing sides of a corresponding one of the terminal openings 142. Each of the protrusions 202 has an interior surface 206, which faces a corresponding terminal 138 (see also interior surface 208 of protrusions 204 facing corresponding terminal 140 in FIGS. 3 and 4), and an exterior surface 210 disposed opposite the interior surface 206 (see also, for example, exterior surface 212 opposite interior surface 208 of protrusion 204 in FIG. 3). The exterior surface 210 of each protrusion 202 aligns with the first side 110,112 of a corresponding one of the first and second housing members 102,104. The interior surface 206 of each protrusion 202 is disposed proximate a corresponding one of the terminal openings 142 of the circuit breaker case 100, and preferably abuts the terminal opening 142, as shown. Accordingly, the example protrusions 202 extend between the terminal opening 142 and the corresponding exterior side 110,112 of the corresponding housing member 102,104. It will, therefore, be appreciated that the terminal shield 200 is substantially wider than known prior art structures (e.g., first and second protrusions 16,18 of FIG. 1) for shielding terminals (e.g., terminal 14 of FIG. 1). More specifically, as shown in FIG. 5, each circuit breaker 30 has a first width 158, and each of the protrusions 202 of terminal shield 200 has a second width 238. In the example shown, the combined second width 238 of the protrusions 202 is preferably at least about 40 percent of the first width 158 of the circuit breaker case 100.

Additionally, unlike the tapered first and second protrusion 16,18 shown and described with respect to FIG. 1, the interior and exterior surfaces 206,210 of the protrusions 202 of the example terminal shield 200 are substantially parallel with respect to one another, and extend substantially perpendicularly outwardly from the first end 114 of the case 100. It will be appreciated that the configuration of each protrusion 204 of the second terminal shield 200', partially shown in FIGS. 3 and 4, extends outwardly from the second end 116 of the circuit breaker case 100 and is substantially identical to the first protrusions 202 of the first terminal shield 200. However, it will also be appreciated that any suitable count and configuration of terminal shields (e.g., 200,200') and protrusions (e.g., 202,204) therefor, could be employed without departing from the scope of the invention.

As best shown in FIGS. 3 and 4, each protrusion 202,204 further includes a first end 214,216, a second end 218,220, a first side 222,224 and a second side 226,228. The first end 214,216 of each protrusion 202,204 is coupled to a corresponding one of the first and second ends 114,116 of the circuit breaker case 100, as shown. The second end 218,220 of each protrusion 202,204 is disposed opposite and distal from the first end 214,216. The first side 222,224 of each protrusion 202,204 extends beyond a corresponding one of the first and second terminal openings 142,144 on one side thereof, and the second side 226,228 of each protrusion 202, 204 extends beyond the corresponding terminal opening 142, 144 on the other side thereof. In this manner, the terminals 138,140 are substantially electrically isolated, for example and without limitation, with respect to adjacent terminals (see, for example, adjacent terminals 142 of adjacent circuit breakers 30 of FIG. 5). The terminal shields 200,200' simultaneously, advantageously do not undesirably interfere (e.g., block; restrict) access to the terminals 138,140.

As previously discussed, the first and second housing members 102 (FIGS. 4 and 5) and 104 (FIGS. 3 and 5) of the circuit breaker case 100 preferably comprise first and second molded housing members made from a single piece of any known or suitable electrically insulative material (e.g., without limitation, plastic). Accordingly, it will be appreciated that the protrusions 202 (FIGS. 3-5) and 204 (FIGS. 3 and 4) of the example terminal shields 200 (FIGS. 3-5) and 200' (FIGS. 3 and 4) are contemplated as comprising first integral extensions 230 (FIGS. 4 and 5) and 232 (FIGS. 3 and 5) extending outwardly from the first ends of the single piece molded members 102 (FIGS. 4 and 5) and 104 (FIGS. 3 and 5), and second integral extensions 234 (FIG. 4) and 236 (FIG. 3), which extend from the second ends of the single piece molded members 102 (FIG. 4) and 104 (FIG. 3). It will be appreciated, however, that the terminal shields 200,200' could, for example and without limitation, comprise separate components (not shown) which are separately made and subsequently coupled to the housing members 102,104.

Accordingly, the disclosed circuit breaker 30 provides a vented case 100 having an optimized number and configuration of vents (e.g., 120,122,124) and venting passages (e.g., 126,128,130,132,134,136), thereby improving the efficiency with which the circuit breaker 30 vents ionized gas 36. Terminal shields (e.g., 200,200') are also provided which, among other benefits, resist undesirable arcing and electrical shorts associated therewith.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A case for an electrical switching apparatus, said case comprising:

an interior;

an exterior;

a first end including a first terminal disposed within the interior, and a first terminal opening extending through said case from the exterior to the interior to provide access to said first terminal;

a second end including a second terminal disposed within the interior, and a second terminal opening extending through said case from the exterior to the interior to provide access to said second terminal;

a first housing member including a first side and a second side;

a second housing member coupled to and disposed opposite from said first housing member to define the interior of said case, said second housing member including a first side and a second side;

a pair of terminal shields comprising:

a pair of first protrusions extending outwardly from the first end of said case on opposing sides of said first terminal opening, a pair of second protrusions extending outwardly from the second end of said case on opposing sides of said second terminal opening, wherein each protrusion of said pair of first protrusions of said pair of terminal shields and said pair of second protrusions of said pair of terminal shields has an interior surface facing a corresponding one of said first terminal and said second terminal, and an exterior surface disposed opposite said interior surface, wherein said exterior surface of said each protrusion aligns with the first side of a corresponding one of said first housing member and said second housing member of said case; and wherein said first housing member and said second housing member together form a plurality of venting passages; wherein said plurality of venting passages collectively form a vent; wherein said vent extends from the interior of said case to the exterior of said case; and wherein, when said case is viewed from an end elevation perspective, said vent is shaped like a capital letter "I".

2. An electrical switching apparatus comprising:

a case including an interior, an exterior, a first end having a first terminal disposed within the interior and a first terminal opening extending through said case from the exterior to the interior to provide access to said first terminal, and a second end having a second terminal disposed within the interior and a second terminal opening extending through said case from the exterior to the interior to provide access to said second terminal;

a first housing member including a first side and a second side;

a second housing member coupled to and disposed opposite from said first housing member to define the interior of said case, said second housing member including a first side and a second side; and a pair of terminal shields comprising:

a pair of first protrusions extending outwardly from the first end of said case on opposing sides of said first terminal opening, a pair of second protrusions extending outwardly from the second end of said case on opposing sides of said second terminal opening, wherein each protrusion of said pair of first protrusions of said pair of terminal shields and said pair of second protrusions of said pair of terminal shields has an interior surface facing a corresponding one of said first terminal and said second terminal, and an exterior surface disposed opposite said interior surface, wherein said exterior surface of said each protrusion aligns with the first side of a corresponding one of said first housing member and said second housing member; and wherein said case further includes a vent extending from the interior of said case to the exterior of said case; and wherein, when said case is viewed from an end elevation perspective, said vent is shaped like a capital letter "I".

* * * * *